US010255857B2

(12) United States Patent
Hyeon et al.

(10) Patent No.: US 10,255,857 B2
(45) Date of Patent: Apr. 9, 2019

(54) IMAGE DISPLAY APPARATUS PERFORMING DISCHARGE OPERATION OF SCAN LINES AND METHOD FOR DRIVING THE SAME

(71) Applicant: SAMSUNG ELECTRONICS CO., LTD., Suwon-si (KR)

(72) Inventors: Byeong-cheol Hyeon, Suwon-si (KR); Tae-hoon Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 152 days.

(21) Appl. No.: 15/234,475

(22) Filed: Aug. 11, 2016

(65) Prior Publication Data

US 2017/0069270 A1 Mar. 9, 2017

(30) Foreign Application Priority Data

Sep. 4, 2015 (KR) ..... 10-2015-0125457

(51) Int. Cl.
*G09G 3/3258* (2016.01)

(52) U.S. Cl.
CPC ..... *G09G 3/3258* (2013.01); *G09G 2300/04* (2013.01); *G09G 2310/08* (2013.01)

(58) Field of Classification Search
CPC ..... G09G 3/3258; G09G 2310/08; G09G 2300/04
See application file for complete search history.

(56) References Cited

U.S. PATENT DOCUMENTS 6,985,124 B1 1/2006 Nogawa
7,221,352 B2 5/2007 Kodate et al.
2004/0189558 A1* 9/2004 Yoshida ..... G09G 3/3216 345/82

(Continued)

FOREIGN PATENT DOCUMENTS

JP 2000-122593 A 4/2000
JP 2001-25085 A 1/2001

(Continued)

OTHER PUBLICATIONS

Anonymous, "Build high density, high refresh rate, multiplexing panel with TLC5958,—a 48 channels, 16-BIT ES-PWM LED driver with pre-charge FET, Led open detection and Display data memory support 32-multiplexing", Texas Instruments Incorporated, Dec. 5, 2013, Dallas, Texas, 39 pages total.

(Continued)

*Primary Examiner* — Kwang-su Yang
(74) *Attorney, Agent, or Firm* — Sughrue Mion, PLLC

(57) ABSTRACT

An image display apparatus and a method for driving the same are provided. The image display apparatus includes a display panel including a light emitting element formed in a pixel area defined by intersection of a plurality of scan lines and a plurality of data lines, the display panel being configured to display an image by controlling the light emitting element, a discharger configured to perform a discharge operation of the plurality of scan lines by time-division control with respect to a discharge line connected to the plurality of scan lines in the number less than the plurality of scan lines, and a controller configured to control the light emitting element and the discharger.

14 Claims, 12 Drawing Sheets

(56) References Cited

U.S. PATENT DOCUMENTS

| | | | | |
|---|---|---|---|---|
| 2004/0263760 | A1 | 12/2004 | Kodate et al. | |
| 2013/0314307 | A1 | 11/2013 | Lin et al. | |
| 2014/0085290 | A1* | 3/2014 | Yu | G09G 3/3291 345/212 |

FOREIGN PATENT DOCUMENTS

| | | | |
|---|---|---|---|
| JP | 2001-109433 | A | 4/2001 |
| JP | 2013-246430 | A | 12/2013 |
| KR | 10-0757766 | B1 | 9/2007 |
| KR | 10-0913523 | B1 | 8/2009 |
| KR | 10-1435718 | B1 | 9/2014 |

OTHER PUBLICATIONS

Anonymous, "TLC5958 48-Channel, 16-Bit ES-PWM LED Driver with Pre-Charge FET, LED Open Detection and Display Data Memory Support 32-Multiplexing", Texas Instruments Incorporated, May 2014, update Sep. 2014, Dallas, Texas, 28 pages total.

* cited by examiner

IMAGE DISPLAY APPARATUS PERFORMING DISCHARGE OPERATION OF SCAN LINES AND METHOD FOR DRIVING THE SAME

CROSS-REFERENCE TO RELATED APPLICATION

This application claims priority from Korean Patent Application No. 10-2015-0125457, filed on Sep. 4, 2015, in the Korean Intellectual Property Office, the disclosure of which is incorporated herein by reference in its entirety.

BACKGROUND

1. Field

Methods and apparatuses consistent with exemplary embodiments relate to an image display apparatus and a method for driving the same, and more particularly, to an image display apparatus which is capable of increasing discharge efficiency, reducing manufacturing costs, and solving an afterimage problem due to a turn-on error of a light emitting element in a self-emitting display apparatus, for example, and a method for driving the same.

2. Description of Related Art

A Flat Panel Display (FPD) may be classified as a light-receiving type display that operates with an external light, such as a backlight, or a light-emitting type display that emits light autonomously, such as a self-emitting display. As a representative example, a light-receiving type display may include a Thin Film Transistor-Liquid Crystal Display (TFT-LCD), and a light-emitting type display may include a Light Emitting Diode (LED), such as those used in electronic display boards or the like. An Organic Light-Emitting Diode (OLED) display may include different organic compounds which emit different colors, such as red (R), green (G), and blue (B).

In general, display apparatuses display an image on a screen using a sequential driving method. The sequential driving method is called a 'scanning method' in that the method drives scan lines (or gate lines) sequentially. That is, the scanning method displays information on the screen by turning on the scan lines sequentially, line by line, in a vertical direction. In a scanning method-type display, when a present scan line is turned on, and then a switching element for connecting the present scan line and power is turned off in order to turn on a next scan line, a voltage of the present scan line is maintained by a parasitic capacitor of a circuit.

In this case, the present scan line is supposed to be turned off when the next scan line is turned on. However, a pixel (for example, an LED or an OLED) of the present scan line is turned on by error due to the voltage, which causes ghosting where light emission occurs at an undesired scan line after a turn of the scan line passed, due to parasitic elements in the circuit.

In order to solve this problem, charges in a parasitic capacitor of a scan line may be discharged through resistance or a zener diode to lower a voltage value of the scan line to a level where the LED is not turned on in a next turn.

However, the resistance or the zener diode is connected to the scan line all the time, which increases power consumption. Further, a turn-on error in a vertical line shape due to a short-circuit in a light-emitting pixel may still occur.

SUMMARY

The present disclosure has been provided to address the aforementioned and other problems and disadvantages, and an aspect of the present disclosure provides an image display apparatus which is capable of increasing the discharge efficiency, reducing the manufacturing costs, and solving the afterimage problem due to the turn-on error of a light emitting element in a self-emitting display apparatus and a method for driving the same.

According to an aspect of an exemplary embodiment, there is provided an image display apparatus including: a display panel including a light emitting element formed in a pixel area defined by intersection of a plurality of scan lines and a plurality of data lines, the display panel being configured to display an image by controlling the light emitting element; a discharger configured to perform a discharge operation of the plurality of scan lines by time-division control with respect to a discharge line connected to the plurality of scan lines in the number less than the plurality of scan lines; and a controller configured to control the light emitting element and the discharger.

The apparatus may further include a gate driver comprising a switching element configured to sequentially connect a power voltage source (Vdd) to each of the plurality of scan lines.

The gate driver may be installed on the display panel in a form of a chip on board, and the switching element may be formed in a manufacturing process of the display panel.

The discharger may include: a reverse-flow preventer connected to each of the plurality of scan lines to control a flow of a parasitic charge formed in each of the plurality of scan lines; a stabilizer connected to the reverse-flow preventer to stabilize the discharge operation; and a switch connected to the stabilizer and a ground, and configured to perform on/off control with respect to the discharge operation.

The discharger may be further configured to perform the discharge operation through one discharge line commonly connected to the plurality of scan lines.

The discharger may be further configured to receive a control signal through one control line connected to the controller.

The display panel may include a first display area and a second display area, the discharge line may include a first discharge line and a second discharge line, and the discharger may be further configured to perform the discharge operation for the first display area via the first discharge line, and the discharge operation for the second display area via the second discharge line.

A control signal provided from the controller to the discharger may have a predetermined duty-on time which is based on occurrence of a short-circuit of a light emitting element connected to the plurality of scan lines.

The controller may be further configured to determine the occurrence of the short-circuit and automatically adjust the duty-on time based on the occurrence of the short-circuit.

According to an aspect of another exemplary embodiment, there is provided a method for driving an image display apparatus, the method including: displaying an image by controlling a light emitting element formed in a pixel area defined by a plurality of scan lines and a plurality of data lines; and performing a discharge operation of the plurality of scan lines by time-division control with respect to a discharge line connected to the plurality of scan lines in the number less than the plurality of scan lines.

The performing the discharge operation may include performing the discharge operation by time-division control with respect to one discharge line commonly connected to the plurality of scan lines.

The performing the discharge operation may include receiving a control signal through one control line connected to a controller providing the control signal.

The displaying the image may include displaying the image on a display panel including a first display and a second display area, the discharge line may include a first discharge line and a second discharge line, and the performing the discharge operation may include performing the discharge operation through the first discharge line for the first display area and performing the discharge operation through the second discharge line for the second display area.

A control signal for controlling the discharge line may have a predetermined duty-on time which is based on occurrence of a short-circuit of a light emitting element connected to the plurality of scan lines.

The method may further include: determining occurrence of the short-circuit of the light emitting element; and adjusting, in response to determining that the short-circuit occurs, the duty-on time of the control signal.

The determining the occurrence of the short-circuit of the light emitting element may include: detecting a voltage of each of the plurality of data lines; comparing the detected voltage of each of the plurality of data lines with a predetermined threshold voltage; and determining, in response to the voltage value of the detected voltage being higher than the predetermined threshold voltage, that a short-circuit occurs.

According to an aspect of yet another exemplary embodiment, there is provided a non-transitory computer readable recording medium having embodied thereon a program, which when executed by a processor of a display apparatus causes the display apparatus to execute a display method, the display method including: displaying an image by controlling a light emitting element formed in a pixel area defined by a plurality of scan lines and a plurality of data lines; and performing a discharge operation of the plurality of scan lines using a discharge line connected to the plurality of scan lines.

BRIEF DESCRIPTION OF DRAWINGS

The above and/or other aspects will be more apparent by describing exemplary embodiments with reference to the accompanying drawings, in which.

DETAILED DESCRIPTION

Figure 1:
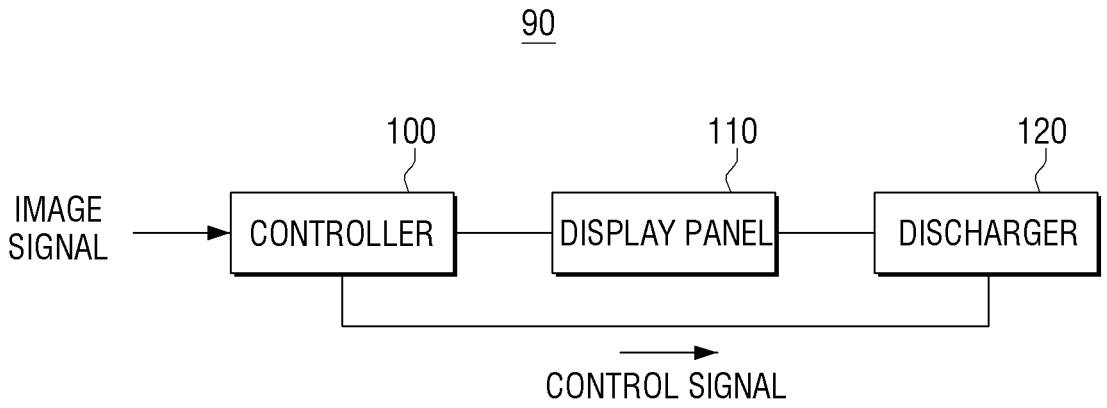
FIG. 1 is a block diagram illustrating an image display apparatus according to a first exemplary embodiment.

Certain exemplary embodiments are described below in greater detail with reference to the accompanying drawings.

In the following description, like drawing reference numerals are used for the like elements, even in different drawings. The matters defined in the description, such as detailed construction and elements, are provided to assist in a comprehensive understanding of exemplary embodiments. However, exemplary embodiments can be practiced without those specifically defined matters. Also, well-known functions or constructions are not described in detail since they would obscure the application with unnecessary detail.

FIG. 1 is a block diagram illustrating an image display apparatus according to the first exemplary embodiment disclosed herein.

As illustrated in FIG. 1, an image display apparatus 90 according to the first exemplary embodiment includes some or all of a controller 100, a display panel 110, and a discharger 120.

Herein, 'including some or all of components' signifies that a certain component may be omitted from the image display apparatus or a certain component, such as, the controller 100 or the discharger 120, may be integrated with another component, such as, the display panel 110. In the following exemplary embodiments, it is described that the image display apparatus 90 includes all of the components for better understanding of the present disclosure.

The controller 100 may include a processor and a memory, for example. Accordingly, data processed by the processor may be stored in the memory. The controller 100 processes an image signal received from an external source and displays an image on the display panel 110. For doing this, the controller 100 may control light emitting elements in the display panel 110 in a sequential driving method to display the image. In this case, the 'sequential driving' refers to an operation of displaying images corresponding to an amount of one horizontal line, that is, image data, one by one in the display panel 110 to form a unit frame image. It may be seen that the controller 100 displays the image by controlling a light emission level of the light emitting elements connected to each of a plurality of scan lines, in this process. By way of example, the light emission level of the light emitting elements is determined by the time constant currents flow to the light emitting elements, and such information is determined by the image data. That is, the time the constant currents flow in each light emitting element varies depending upon the inputted image data or gradation information, which indicates that the light emitting elements are controlled in a constant current-Pulse Width Modulation (PWM) method.

Figure 2:
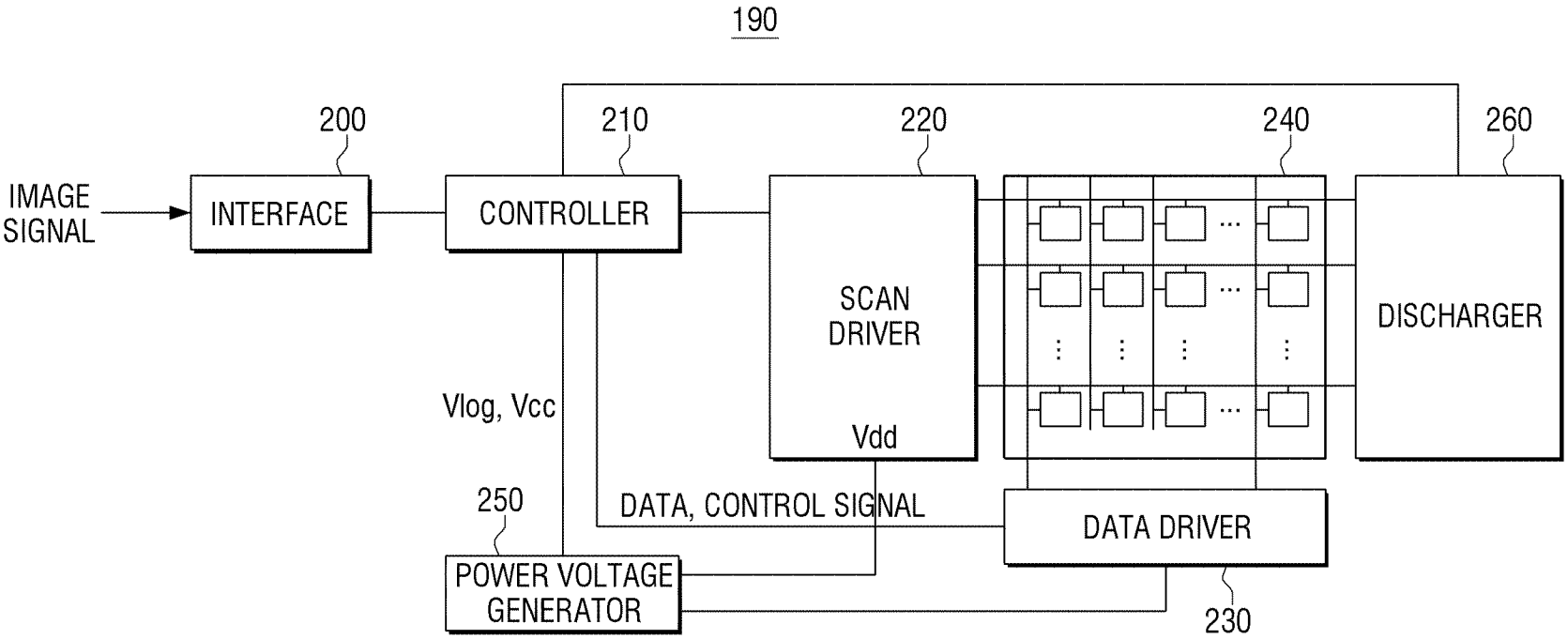
FIG. 2 is a block diagram illustrating an image display apparatus according to a second exemplary embodiment.

In order to perform the above operation, the controller 100 may include some or all of an interface 200, a controller 210, a scan driver 220, a data driver 230, and a power voltage generator 250 illustrated in FIG. 2. FIG. 2 shows an example where respective function blocks of the image display apparatus are separated physically, that is, in a hardware manner, but the exemplary embodiment of FIG. 1 is not limited thereto. Accordingly, the controller 100 of FIG. 1 may be realized as software by integrating the specific functions.

According to an exemplary embodiment disclosed herein, the controller 100 may control the discharger 120. For doing this, the controller 100 transmits a control signal through one control line connected to the discharger 120 to control a discharge operation of the discharger 120. In other words, the controller 100 controls the entire scan lines of the display panel 110 through one control line connected to the discharger 120. The number of control lines is closely related with the manufacturing costs, and thus, it is preferred to use one control line. However, any number of control lines may be used according to a method for displaying an image in the display panel 110. As described below, when a screen is split, the image display apparatus may include the control lines in the number corresponding to the number of split screens. Accordingly, the exemplary embodiments disclosed herein do not limit the number of control lines.

According to an exemplary embodiment disclosed herein, in response to a plurality of scan lines of the display panel 110 sequentially being driven, the controller 100 performs a discharge operation of Scan line 1 that was driven in advance of Scan line 2 that will be driven from now, such that parasitic charges generated by a parasitic capacitor of Scan line 1 are discharged quickly. The controller 100 may solve the ghosting of the display panel 110 through the above operation. Further, in response to the plurality of scan lines sequentially being driven, the controller 100 performs the discharge operation of each scan line through one control line, thereby reducing the manufacturing costs considerably.

In the image display apparatus 90 according to an exemplary embodiment disclosed herein, two scan lines may be driven simultaneously in response to occurrence of a short-circuit in a light emitting element connected to a certain scan line, even though it is not an image display method. According to the exemplary embodiment, a pulse width of the control signal transmitted to the discharger 120 may be predetermined by considering the above circumstances. In this case, the 'pulse width' refers to a duty-on time of a control signal. In addition, 'predetermining a pulse width' signifies that measuring and determining the pulse width through experiments based on theoretical analyses and assumptive circumstances where a short-circuit is likely to occur. In this case, it may be seen that the duty-on time determined experimentally is within a range where afterimages do not occur in the other light emitting elements of the scan line connected to the shorted light emitting element. As the result, the pulse width of the control signal predetermined according to the exemplary embodiment is optimized to be used in both a case where the light emitting elements operate normally and a case where a certain light emitting element is shorted.

In other words, in response to two scan lines being driven as a light emitting element connected to a certain scan line is shorted, the afterimage occur by the other light emitting elements of the scan line where the short-circuit occurred. Such afterimage occurs because the shorted light emitting element increases potentials of the scan lines connected to the other light emitting elements where no short-circuit occurs. Accordingly, in the present exemplary embodiment, the pulse width is predetermined or adjusted to remove or decrease the potential difference.

According to the exemplary embodiment, the pulse width does not necessarily need to be predetermined. For example, the controller 100 may determine whether a short-circuit occurs by comparing a value of a voltage detected through each data line with a threshold voltage set for the display panel 110 or a data driver 230 (or converting the voltage value). In response to determining that the detected voltage value is higher than the threshold voltage, the controller 100 may determine that the short-circuit occurred in a light emitting element in a corresponding turn. This operation may be performed in real time or may be performed periodically to reduce the power consumption. Accordingly, when the operation is performed automatically, the controller 100 may vary and output the pulse width of the control signal. That is, the controller 100 may perform PWM-control with respect to the pulse width.

The display panel 110 includes an LED panel or an OLED panel that displays an image by self-emission. The light emitting elements, such as, the LED or the OLED, of the display panel 110 may be manufactured concurrently with a process for forming a plurality of scan lines and data lines on a substrate. Further, a manufactured LED module may be mounted on a substrate where the plurality of scan lines and data lines have been formed. Accordingly, the exemplary embodiments disclosed herein are not limited to a particular method for manufacturing or assembling the display panel 110.

The display panel 110 manufactured by the above process has a pixel area defined (or divided) by intersection of the plurality of scan lines and data lines. In other words, the pixel area is formed by being surrounded (or divided) by the scan lines and the data lines. Further, individual R-G-B LED elements may be assembled in the pixel area, or the R-G-B LED elements in a form of one package may be assembled in the pixel area. In this case, 'one package' refers to a form where individual chips outputting R-G-B lights are molded by transparent resin. Further, the display panel 110 may consist of a package consisting of chips with a certain repeated color pattern, such as, R-R-G-B, R-G-G-B, or R-G-B-B or may consist of a package with white, for example, R-G-B-W.

The discharger 120 performs the discharge operation of the plurality of scan lines in the display panel 110. In other words, the discharger 120 generates a discharge path for each scan line. According to an exemplary embodiment disclosed herein, the discharger 120 performs the discharge operation by controlling one discharge line commonly connected to the plurality of scan lines according to the sequential driving method. For instance, the discharger 120 may perform the discharge operation by control of the controller 100, connect a certain scan line to the ground through discharge resistance, and generate the discharge path. Accordingly, all of the parasitic charges formed by the parasitic capacitor of each scan line are discharged to the ground. In this regard, it may be seen that the controller 100 transmits the same control signals for the respective scan lines to the discharger 120 through one control line, according to the sequential driving method.

The discharger 120 includes a switching element which is turned on or turned off by the control signal received from the controller 100. The discharger 120 may further include other elements for stably performing the discharge operation. For example, the discharger 120 may include a rectifying element for preventing a reverse-flow between each scan line and the switching element connected to the ground. In addition, the discharger 120 may further include the resistance for reducing electromagnetic interference (EMI), noises, or peak currents. The resistance may be connected to a cathode terminal of a diode and one terminal of the switching element or may be connected between the switching element and the ground. A detailed description on this operation will be provided below.

Figure 3:
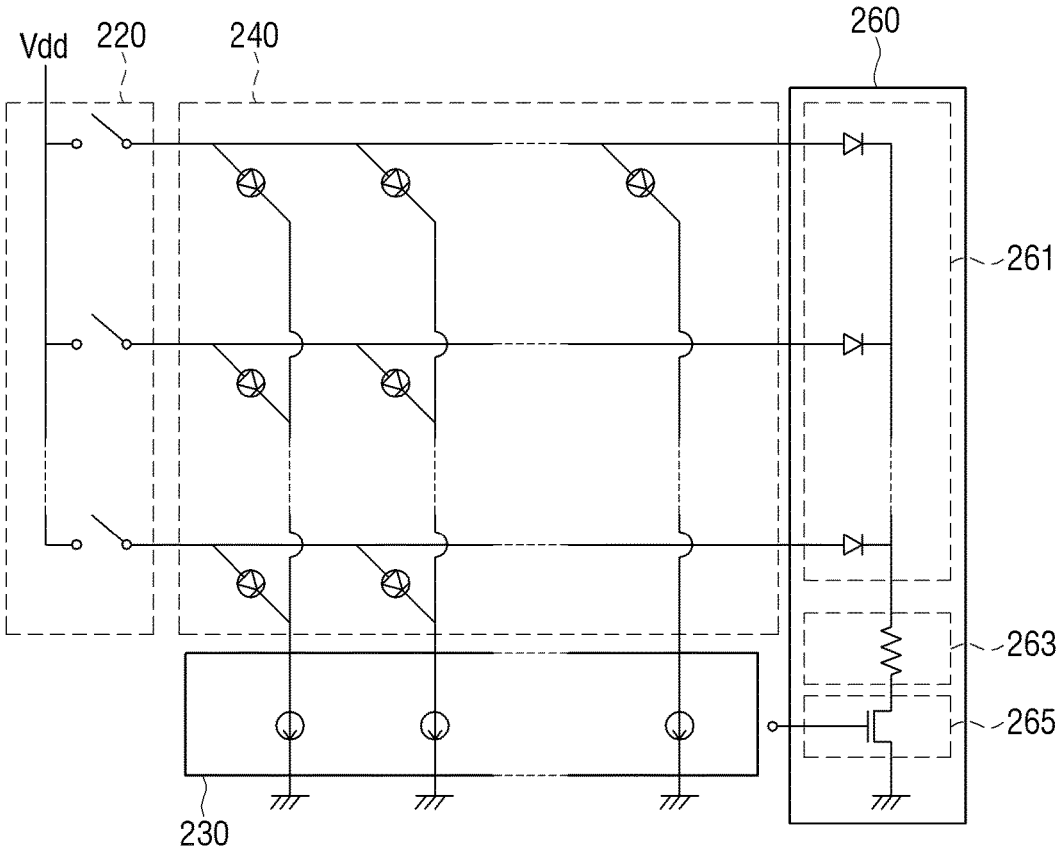
FIG. 3 is a circuit diagram provided to exemplify a detailed structure of a gate driver, a data driver, a display panel, and a discharger of FIG. 2.

FIG. 2 is a block diagram illustrating an image display apparatus according to the second exemplary embodiment disclosed herein. FIG. 3 is a circuit diagram provided to exemplify a detailed structure of a gate driver, a data driver, a display panel, and a discharger of FIG. 2.

As illustrated in FIG. 2, an image display apparatus 190 according to the second exemplary embodiment includes some or all of an interface 200, a controller 210, a scan driver 220, a data driver 230, a display panel 240, a power voltage generator 250, and a discharger 260. The meaning of the phrase 'includes some or all of components' has been described above, and thus, a repeated description is omitted.

The interface 200 is an image board, for example, a graphic card. The interface 200 may convert and output image data received from an external source to be suitable for resolution of the image display apparatus 190. In this case, the image data may consist of 8 bits or more of R-G-B video data, and the interface 200 generates the control signals, such as, a clock signal suitable for the resolution of the image display apparatus 190, a vertical synchronizing signal (Vsync), a horizontal synchronizing signal (Hsync), or the like. The interface 200 transmits the vertical synchronizing signal (Vsync) or the horizontal synchronizing signal (Hsync) and the image data to the controller 210.

On top of the above components, the interface 200 may further include a tuner for receiving a certain broadcasting program from an external broadcasting station, a demodulator for demodulating an image signal received through the turner, a demultiplexer for dividing the demodulated image signal into video data, audio data, and additional information, a decoder for decoding each of the divided video data and audio data, an audio processor for converting a format of the decoded audio data to be suitable for a speaker, or the like.

The controller 210 generates a control signal for controlling the scan driver 220 and the data driver 230 in order to display the inputted R-G-B image date in the display panel 240. Further, the controller 210 may express the gradation information of the R-G-B data by using a logic voltage (Vlog) provided by the power voltage generator 250. For example, in response to the gradation information of a' being generated by using the logic voltage of 3.3 V, the controller 210 may denote 3.3 V by 1 and denote 0 V by 0 to generate 8-bit information '10001001.'

The controller 210 may generate Gate Shift Clock (GSC), Gate Output Enable (GOE), or Gate Start Pulse (GSP) as a gate control signal for controlling the scan driver 220. The GSC may be a signal for determining a time for turning on or turning off the switching element connected to the light emitting elements, such as, the R-G-B LED (or the OLED), the GOE may be a signal for controlling an output of the scan driver 220, and the GSP may be a signal for indicating the first driving line in the screen out of one vertical synchronizing signal.

Further, the controller 210 may generate Source Sampling Clock (SSC), Source Output Enable (SOE), or Source Start Pulse (SSP) as a data control signal. In this case, the SSC may be used as a sampling clock for latching data in the data driver 230, the SOE may transmit the data latched by the SSC to the display panel 240, and the SSP may be a signal for notifying latching of the data or start of sampling during one horizontal synchronizing period.

More particularly, when the data driver 230 is realized by using an Integrated Circuit (IC) in a TCL5958 series of Texas Instruments Inc., the controller 210 according to an exemplary embodiment disclosed herein may be configured to process the IC and signals including a data signal, serial data shift clock (S CLK), LAT, Grayscale (GS) pulse width modulation (PWM) reference clock (G CLK), or the like. In this case, the data signal is R-G-B gradation data. The S CLK refers to a signal for synchronizing data inputted in the data driver 230 with a positive edge of the S CLK and shifting the data to a shift register (for example, 48-bit common shift register, MSB). The data stored in the shift register is shifted to the MSB at each positive edge of the S CLK. The LAT is a signal for latching the data from the MSB to a memory (for example, a GS data memory) at a falling edge. The G CLK is a signal for increasing a GS counter one by one at each positive edge of the G CLK for the PWM-control. The above-described diverse signals may vary, and the exemplary embodiments disclosed herein are not limited thereto.

Considering the above description, the controller 210 may include a control signal generator and a data re-arranger. Assuming that a time for displaying a unit frame image in the display panel 240 is 16.7 ms, the control signal generator generates a control signal for displaying the unit frame image within the time. The data re-arranger may reprocess the inputted R-G-B image data to be suitable for the display panel 240. For example, the data re-arranger may convert 8-bit data to 64-bit data.

The scan driver 220 receives a gate-on voltage (Vdd) and a gate-off voltage (Vss) provided by the power voltage generator 250 and applies the voltages to the display panel 240 by control of the controller 210. In the exemplary embodiments disclosed wherein, the gate-off voltage (Vss) is configured to be a ground voltage. The gate-on voltage (Vdd) is provided sequentially from Scan line 1 (GL 1) to Scan line N (GLn) to realize the unit frame image in the display panel 240. Needless to say, the scan driver 220 is driven in response to a scan signal generated by the controller 210 according to an exemplary embodiment. For doing this, the scan driver 220 may include the switching element connected to the power voltage source and the respective scan lines, as illustrated in FIG. 3. The switching element may be realized by using a Thin Film Transistor (TFT), a transistor (TR), or a metal-oxide semiconductor field-effect-transistor (MOSFET).

The data driver 230 may convert serial R-G-B video data provided by the controller 210 to parallel video data and convert digital data to an analog current or to a duty-on current (for example, a pulse current), thereby simultaneously providing the video data corresponding to an amount of one horizontal line to the display panel 240 and sequentially providing the video data to each horizontal line. For example, digital information on the video data provided by the controller 210 is converted to the analog current for expressing the gradation of a color and provided to the display panel 240. The analog current may be a current in a pulse form. In this case, it is preferred that the data driver 230 is also synchronized with a date signal provided to the scan driver 220 to output unit frame data.

A detailed structure of the data driver 230 has been commonly known to a person having ordinary skill in the art (hereinafter referred to as 'those skilled in the art'), and thus, a detailed description that may obscure the scope of the present disclosure is omitted. That is, diverse alterations may be applied to the structure of the data driver 230 depending on whether to drive the light emitting elements by a constant current or by a constant voltage. Accordingly, in the exemplary embodiments disclosed herein, the constant current is illustrated as a current source as shown in FIG. 3, for convenience in explanation. However, the data driver 230 may be realized by using the IC of TLC 5958 series of Texas Instruments Inc.

The display panel 240 has the plurality of scan lines and data lines which intersect to define a pixel area, and the R-G-B light emitting elements, such as, the LED (or the OLED), are formed in the pixel area. In response to a power voltage being applied to the respective scan lines of the display panel 240, and then a current path being formed between the scan lines and the ground through the data driver 230, the light emitting elements generate currents corresponding to the gradation information thereof through the data line connected to the scan line being supplied with the power voltage. According to an exemplary embodiment disclosed herein, brightness for displaying an image of the display panel 240 is adjusted according to an amount of charges which flow along the current path. Needless to say, the light emitting elements may be driven by the constant current, and thus, the exemplary embodiments disclosed herein are not limited to the above example.

The power voltage generator 250 receives a commercial power from an external source, that is, an Alternating Current (AC) voltage of 110 V or 220 V to generate and output various levels of Direct Current (DC) voltage. As an example, the power voltage generator 250 may generate and provide a DC voltage of 3.3 V as the logic voltage for the controller 210 to express the gradation. As another example, the power voltage generator 250 may generate and provide various level of voltages, for example, a DC voltage of 4.5 V, as the gate-on voltage (Vdd) for the scan driver 220. In response to the controller 210, the scan driver 220, and the data driver 230 being realized as the IC, the power voltage generator 250 may generate a Vcc voltage to be inputted into the IC.

In response to the respective scan lines of the display panel 240 being discharged, the discharger 260 discharges the parasitic charges by the parasitic capacitor of the respective scan lines to the ground. In this case, the discharger 260 may be controlled by the controller 210. In this case, the control operation is performed between a time the power voltage (Vdd) supplied to Scan line 1 is cut off and a time the power voltage is supplied to Scan line 2. The operations of the discharger 260 have been described above, and an additional description is omitted.

However, referring to the structure of the discharger 260 more closely with reference to FIG. 3, the discharger 260 may include some or all of a reverse-flow preventer 261, stabilizer 263, and a switch 265. The meaning of the phrase 'includes some or all of components' has been described above, and a repeated description is omitted.

The reverse-flow preventer 261 includes rectifying elements, that is, diodes. The reverse-flow preventer 261 prevents the charges from flowing reversely. an anode terminal of each rectifying element is connected to each scan line, and a cathode terminal is connected to one side of the resistance in the stabilizer 263.

For example, the stabilizer 263 may include the resistance, and the other side of the stabilizer 263 is connected to the switching element in the switch 265. The stabilizer 263 stabilizes the discharge operation. The stabilizing operation may include preventing the EMI, reducing noises and peak currents, and so on, for instance.

The switch 265 includes a TFT element, a MOSFET, a TR, or the like which forms a discharge path between the power voltage source and the ground. According to this operation, the parasitic charges by the parasitic capacitor in each scan line are discharged to the ground.

Figure 4A:
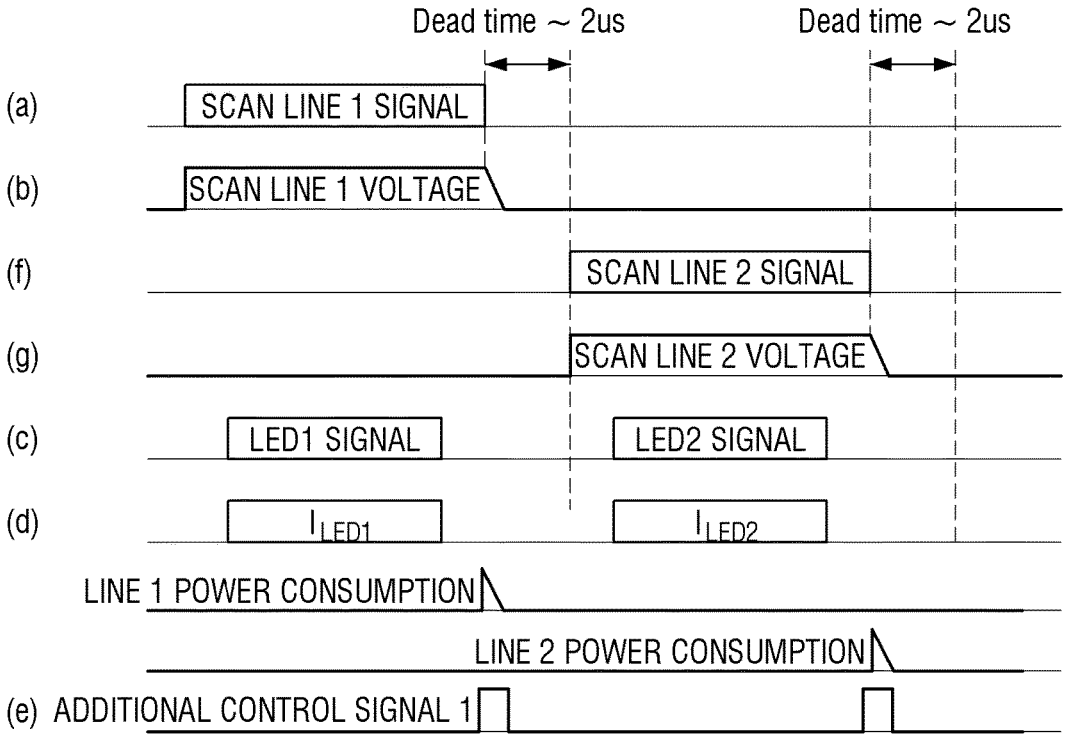
FIG. 4A is a control-timing diagram provided to describe a control timing of the display panel and the discharger of FIG. 3.
Figure 4B:
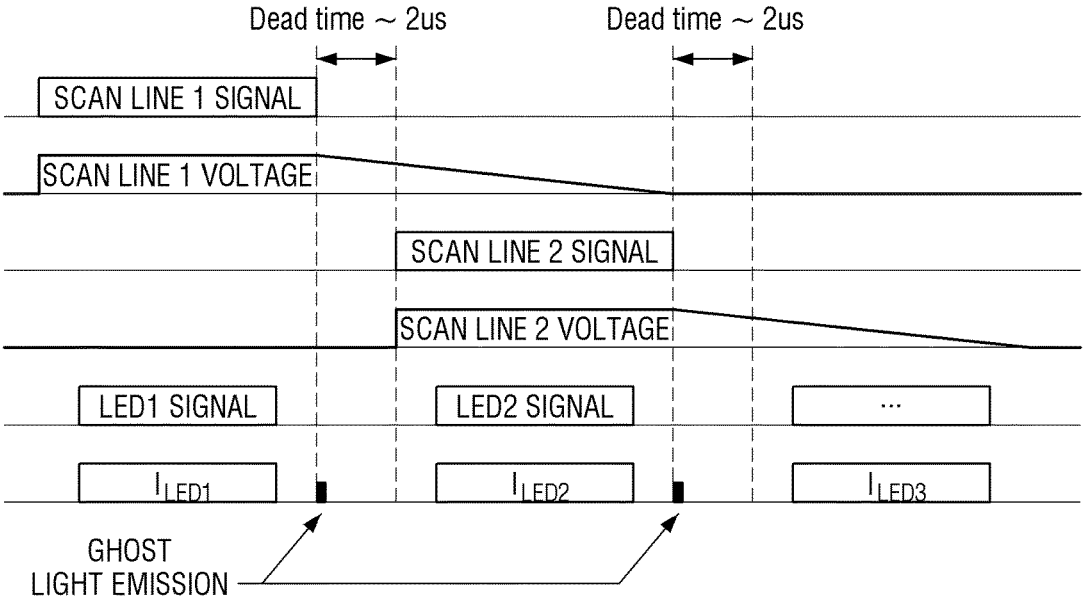
FIG. 4B is a diagram provided to describe a time ghosting occurs.

FIG. 4A is a control-timing diagram provided to describe a control timing of the display panel and the discharger of FIG. 3, and FIG. 4B is a diagram provided to describe a time ghosting occurs.

Referring to FIGS. 4A and 4B along with FIGS. 2 and 3 for convenience in explanation, the controller 210 of the image display apparatus 190 according to the second exemplary embodiment applies a scan line control signal of FIG. 4A (a) to the scan driver 220. Accordingly, the scan driver 220 may apply the power voltage to Scan line 1 of the display panel 240, as illustrated in FIG. 4A (b).

Subsequently, the controller 210 transmits a control signal for controlling the light emitting elements to the data driver 230, as illustrated in FIG. 4A (c). Accordingly, the data driver 230 allows the light emitting elements of the entire data lines connected to Scan line 1 to generate different current conduction times based on the inputted gradation information. In other words, it may be seen that the light emitting elements connected to Scan line 1 represent the gradation information corresponding to an amount of one horizontal line of a unit frame.

The controller 210 cuts off the power voltage supplied to Scan line 1 and then supplies the power voltage to Scan line 2 (refer to FIGS. 4A (f) and (g)). In this case, the controller 210 transmits the control signal of FIG. 4A (e) to the discharger 260 in order to cut off the power voltage supplied to Scan line 1 and discharge the parasitic charges in Scan line 1.

Accordingly, the respective scan lines are discharged through one discharge line by the discharger 260.

In order to perform the above control operation, the controller 210 may generate the control signal to be transmitted to the discharger 260 by mean of a clock generator for generating a clock in synchronization with the falling edge of the scan line control signal, for example, a flip-flop.

As the consequence of the above operation, the ghosting in a scan line driven in advance of each scan line may be solved, as illustrated in FIG. 4B.

Figure 5A:
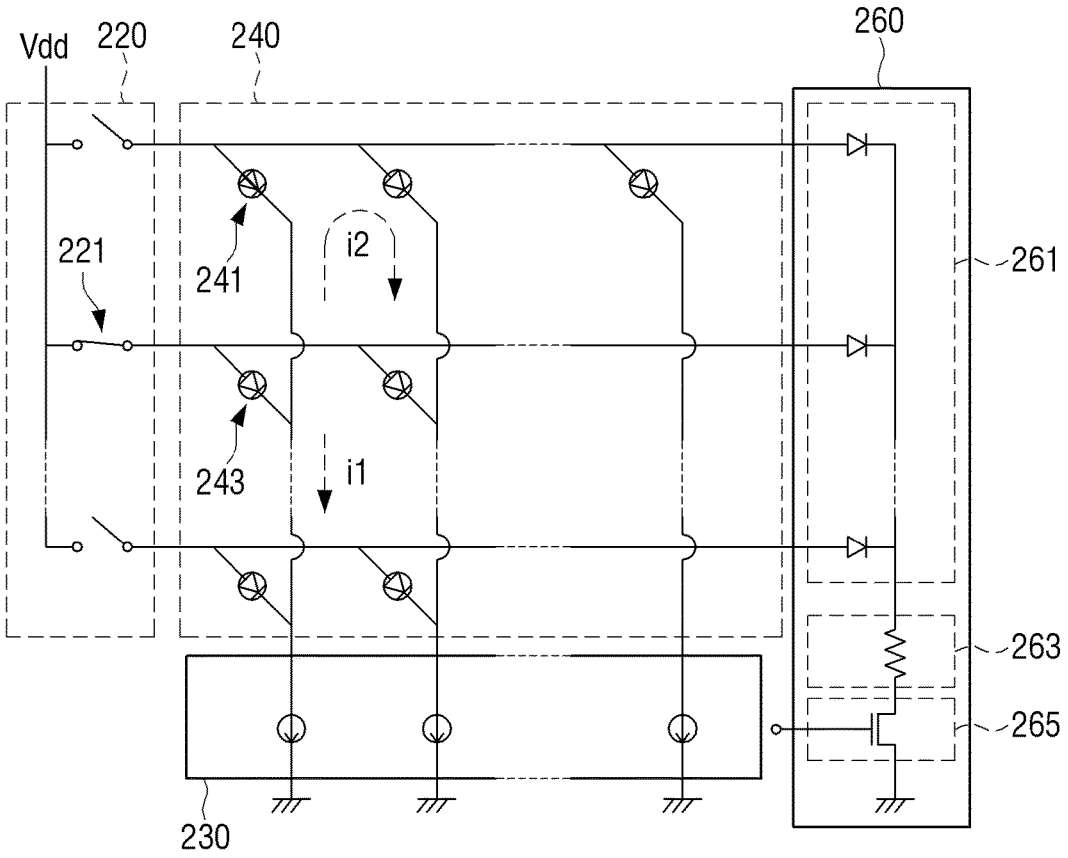
FIG. 5A is a diagram provided to describe an operation of an image display apparatus when a short-circuit occurs in a light emitting element.
Figure 5B:
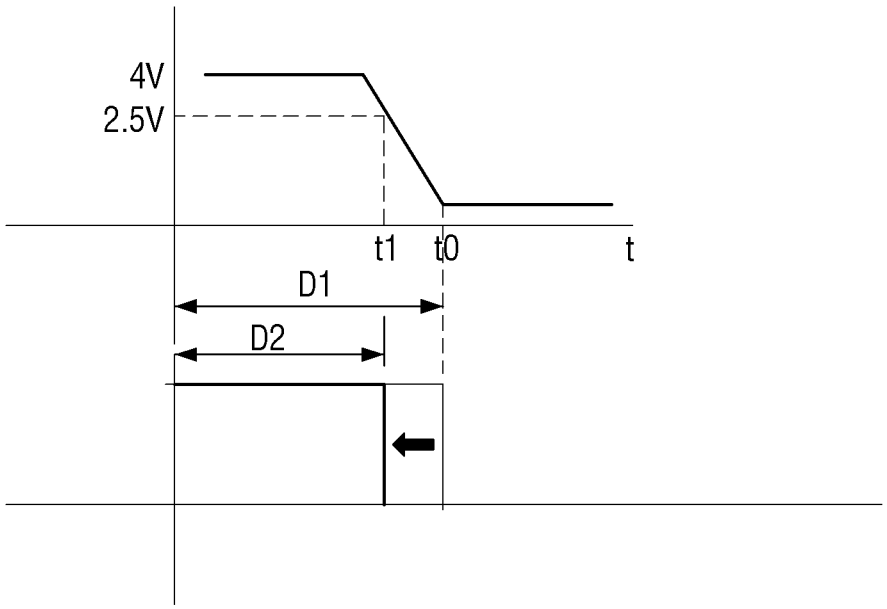
FIG. 5B is a diagram provided to describe a control signal used when a short-circuit occurs in a light emitting element.

FIG. 5A is a diagram provided to describe an operation of an image display apparatus when a short-circuit occurs in a light emitting element, and FIG. 5B is a diagram provided to describe a control signal configured to be used when a short-circuit occurs in a light emitting element.

Referring to FIG. 5A along with FIG. 2 for convenience in explanation, the image display apparatus 190 according to the second exemplary embodiment includes the display panel 240 consisting of the light emitting elements, and a short-circuit may occur in at least one of the light emitting elements. By way of example, it is assumed that an LED-1 241 connected to Scan line 1 is shorted, a second switching element 221 of the scan driver 220 is turned on, and an LED-2 243 connected to Scan line 2 realizes block.

In this case, the switch 265 of the discharger 260 is turned off when the second switching element 221 of the scan driver 220 is turned on, and the LED-2 243 realizes the black. However, a current path ($i_2$) is formed in the LED-1 241 connected to the LED-2 243 and the other light emitting elements connected to Scan line 1, and an afterimage occurs.

According to an exemplary embodiment disclosed herein, in order to solve the afterimage problem due to the short-circuit, only a part of the parasitic charges of the parasitic capacitor, not the entire parasitic charges, are discharged when the discharger 260 performs the discharge operation of Scan line 1, such that a potential difference in Scan line 1 is adjusted. That is, adjusting the potential difference is to remove a current flow through Scan line 1, because the afterimage problem may be solved naturally when there is no current flow.

Accordingly, in the exemplary embodiments disclosed herein, a control signal to be used in both a case where a short-circuit occurs and a case where no short-circuit occurs is determined by considering all circumstances through the experiments. In other words, it may be seen that the duty-on time, that is, a pulse width of the control signal to be applied to the discharger 260 is determined. For example, as illustrated in FIG. 5B, the duty-on time of 't0' may be required to fully discharge a certain scan line. When only a part of the scan lines are discharged, the duty-on time of 't1' may be required. In this case, the scan lines are not fully discharged, and the voltage charged in the parasitic capacitor of the discharged scan lines may remain.

As described in the above exemplary embodiment, the duty-on time may be predetermined by the experiments. However, a duty ratio may be adjusted by automatically determining a short-circuit. For example, the data driver 230 may detect a voltage outputted through a certain data line and compare a voltage value of the detected voltage with a predetermined threshold voltage in order to determine whether a light emitting element of the certain data line is shorted. Accordingly, in response to determining that the short-circuit occurs, the controller 210 of FIG. 2 may transmit a control signal whose duty has been varied to the discharger 260. In this case, varying the duty of the control signal may be called 'PWM control.' That is, the pulse width of the control signal may be predetermined as described above, but the exemplary embodiments disclosed herein are not limited thereto.

Figure 6:
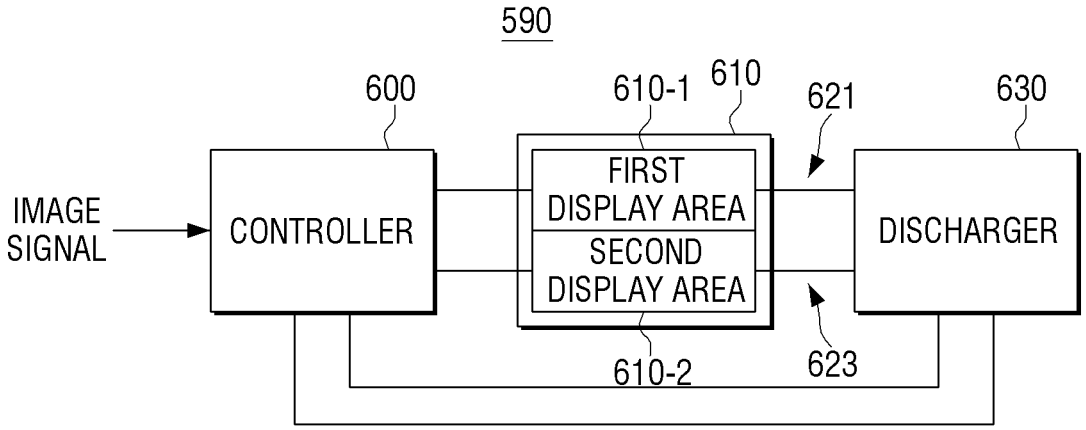
FIG. 6 is a block diagram illustrating an image display apparatus according to a third exemplary embodiment.
Figure 7:
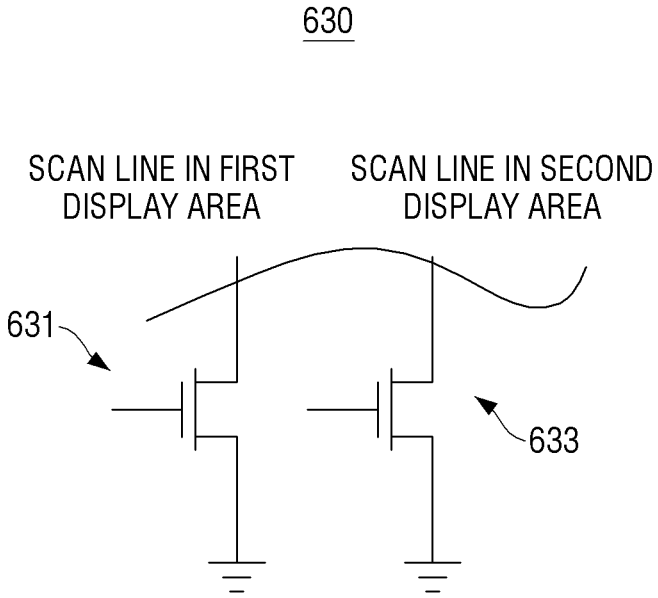
FIG. 7 is a circuit diagram illustrating a switch in a discharger of FIG. 6.

FIG. 6 is a block diagram illustrating an image display apparatus according to the third exemplary embodiment disclosed herein. FIG. 7 is a circuit diagram illustrating a switch in a discharger of FIG. 6.

An image display apparatus 590 of FIG. 6 does not differ considerably from the image display apparatus 90, 190 of FIGS. 1 and 2 in terms of overall structure thereof. However, the image display apparatus 590 of FIG. 6 displays an image in a display panel 610 according to a different method, and thus, a structure and an operating mode of a data driver managing each display area for image display may differ partly. However, the structure or the operating mode may be easily derived by those skilled in the art from the above descriptions, and thus, a detailed description is omitted.

FIG. 6 shows an example where an image display apparatus that displays an image by 120 Hz may achieve an effect of displaying the image by 240 Hz by splitting a screen. Further, the image display apparatus may be configured so as to distribute the power consumed by the light emitting elements thereby reducing the noises in a circuit or improving the image quality. Assuming that the image display apparatus 590 operates in the above method, a discharger 630 according to an exemplary embodiment may perform the discharge operation of the respective scan lines through at least two discharge lines 621, 623. Accordingly, the discharger 630 may include first and second switching elements 631, 633 connected to the ground as illustrated in FIG. 7. In this case, the first and second switching elements 631, 633 perform the discharge operation simultaneously, and thus, it is preferred that the first and second switching elements 631, 633 are driven simultaneously by a controller 600.

Referring to FIG. 6, a control signal is transmitted from the controller 600 to the discharger 630 through two control lines, but the discharger 630 may receive and distribute one control signal. Accordingly, any number of control lines may be used.

The image display apparatus 590 according to the third exemplary embodiment does not differ considerably from the image display apparatus 90, 190 of FIGS. 1 and 2 except for the above difference, and thus, a detailed description is omitted.

Figure 8:
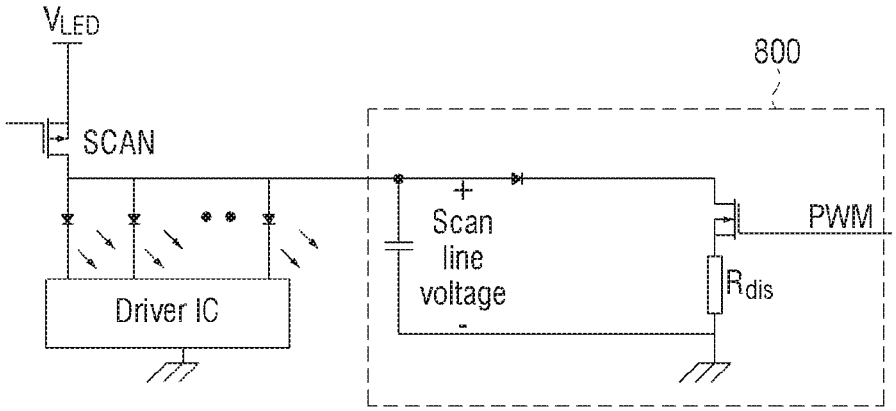
FIG. 8 is a circuit diagram illustrating a discharger according to another exemplary embodiment.
Figure 9:
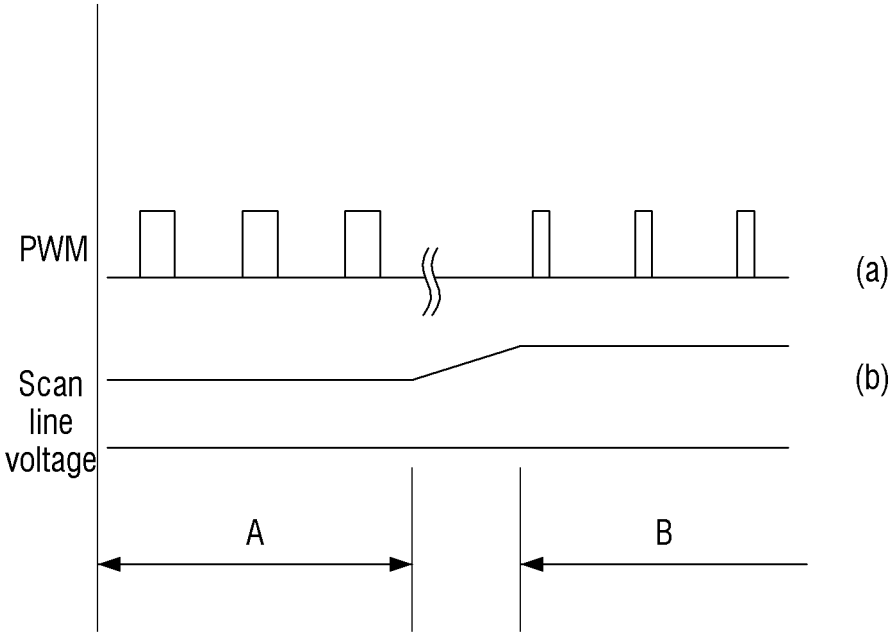
FIG. 9 is a diagram provided to describe an operation of regulating a voltage of a scan line according to Pulse Width Modulation (PWM)

FIG. 8 is a circuit diagram illustrating a discharger according to another exemplary embodiment disclosed herein, and FIG. 9 is a diagram provided to describe an operation of regulating a voltage of a scan line according to Pulse Width Modulation (PWM).

Referring to FIGS. 8 and 9, a discharger 800 according to another exemplary embodiment may include a reverse-flow preventer, a stabilizer, and a switch, in the same manner of the discharger 260 of FIG. 3. On top of the above components, the discharger 800 may further include a charger.

The reverse-flow preventer includes rectifying elements, that is, diodes, and an anode terminal of the rectifying element is connected to each scan line. The switch includes a switching element, and one terminal of the switching element is connected to a cathode terminal of the rectifying element. The stabilizer includes resistance (Rdis) connected between the other terminal of the switching element and the ground. The charger may include a capacitor connected between the anode terminal of the rectifying element and the ground.

According to the above structure, the switching element of FIG. 8 is driven by receiving a control signal of FIG. 9A (a) from the controller 100 of FIG. 1 or the controller 210 of FIG. 2. For example, in response to no short-circuit occurring in a random light emitting element, the switching element is driven by the control signal of FIG. 9A (a). In response to a short-circuit occurring in a random light emitting element, the switching element may be controlled by adjusting the duty-on time of the control signal, as illustrated in FIG. 9 (*b*).

As the switching element is controlled as above, a voltage charged in a scan line connected to the shorted light emitting element is changed as illustrated in FIG. 9 (*b*). This operation has been described above, and thus, a repeated description is omitted.

This exemplary embodiment is intended to focus on the aspects where the discharger 800 may be configured in diverse manners by considering the short-circuit of the light emitting element, the control signal may be set by default, and the duty ratio may be adjusted automatically in response to determining that the short-circuit occurred. By way of example, a voltage charged in the capacitor is voltages at both ends, but the voltage needs to further include voltages at both ends of the rectifying element ideally. This matter may be ignored in a circuit design process, which may vary when two rectifying elements are connected in series. That is, the voltage charged in the capacitor should be the sum of the voltages at both ends of the two rectifying elements connected in series and the voltages at both ends of the resistance. Accordingly, the duty-on time may be determined by considering the above various aspects.

Figure 10:
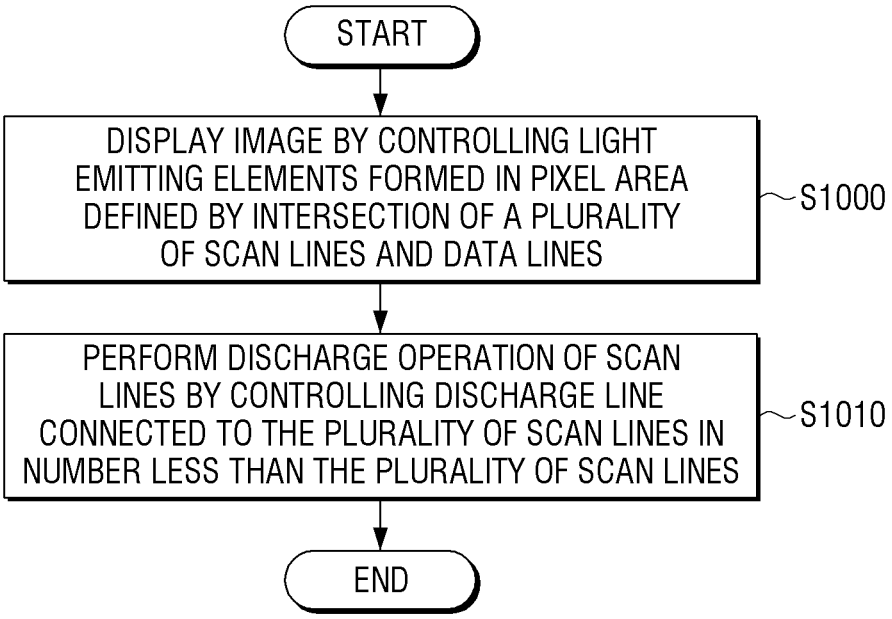
FIG. 10 is a flowchart provided to describe an operation of driving an image display apparatus according to an exemplary embodiment.

FIG. 10 is a flowchart provided to describe an operation of driving an image display apparatus according to an exemplary embodiment disclosed herein.

Referring to FIG. 10 along with FIG. 1 for convenience in explanation, the display panel 110 of the image display apparatus 90 according to the first exemplary embodiment displays an image by controlling the light emitting elements formed in a pixel area defined by intersection of the plurality of scan lines and the plurality of data lines (S1000).

The discharger 120 of the image display apparatus 90 performs the discharge operation by controlling the discharge line connected to the plurality of scan lines in the number less than the plurality of scan lines (S1010).

The operating process of the image display apparatus 90 has been described above with reference to FIG. 4A, and thus, a repeated description is omitted.

As described above, the image display apparatus 90, 190, 590 according to the exemplary embodiments may increase a discharge efficiency of the discharge operation, reducing the manufacturing costs. Table 1 is provided to compare the effects of the conventional method and the proposed method of the present disclosure.

TABLE 1

| | Resistance and control method | Proposed method |
|---|---|---|
| Required elements | Resistance and Zener 60EA | Diode 60EA 1EA for each of MOSFET and resistance |
| Power consumption (Module) | 2 W | 0.27 W |
| FPGA control signal | 0 | 1 |

Referring to [Table 1], it may be inferred that the proposed method according to the exemplary embodiments disclosed herein requires less number of elements and less power consumption as opposed to the conventional method.

Further, according to the proposed method, although a short-circuit occurs in a certain light emitting element, the image quality may be improved by simultaneously resolving the short-circuit and the resultant afterimage problem.

As above, a few exemplary embodiments have been shown and described. The foregoing exemplary embodiments and advantages are merely exemplary and are not to be construed as limiting the present inventive concept. The present teaching can be readily applied to other types of devices. Also, the description of the exemplary embodiments is intended to be illustrative, and not to limit the scope of the claims, and many alternatives, modifications, and variations will be apparent to those skilled in the art.

What is claimed is:

1. An image display apparatus comprising:

a display panel comprising a light emitting element formed in a pixel area defined by intersection of a plurality of scan lines and a plurality of data lines, the display panel being configured to display an image by controlling the light emitting element;

a discharger configured to perform a discharge operation of the plurality of scan lines by time-division control with respect to a discharge line connected to the plurality of scan lines, wherein a number of discharge lines is less than that of the plurality of scan lines; and a controller configured to control the light emitting element and the discharger, wherein a control signal provided from the controller to the discharger has a predetermined duty-on time based on a short-circuit state of the light emitting element connected to the plurality of scan lines.

2. The image display apparatus as claimed in claim 1, further comprising a gate driver comprising a switching element configured to sequentially connect a power voltage source (Vdd) to each of the plurality of scan lines.

3. The image display apparatus as claimed in claim 2, wherein the gate driver is installed on the display panel in a form of a chip on board, and wherein the switching element is formed in a manufacturing process of the display panel.

4. The image display apparatus as claimed in claim 1, wherein the discharger comprises:

a reverse-flow preventer connected to each of the plurality of scan lines to control a flow of a parasitic charge formed in each of the plurality of scan lines;

a stabilizer connected to the reverse-flow preventer to stabilize the discharge operation; and a switch connected to the stabilizer and a ground, and configured to perform on/off control with respect to the discharge operation.

5. The image display apparatus as claimed in claim 1, wherein the discharger is further configured to perform the discharge operation through one discharge line commonly connected to the plurality of scan lines.

6. The image display apparatus as claimed in claim 5, wherein the discharger is further configured to receive a control signal through one control line connected to the controller.

7. The image display apparatus as claimed in claim 1, wherein the display panel comprises a first display area and a second display area, the discharge line comprises a first discharge line and a second discharge line, and the discharger is further configured to perform the discharge operation for the first display area via the first discharge line, and the discharge operation for the second display area via the second discharge line.

8. The image display apparatus as claimed in claim 1, wherein the controller is further configured to determine whether the light emitting element is the short-circuit and automatically adjust the duty-on time of the control signal based on occurrence of the short-circuit.

9. A method for driving an image display apparatus, the method comprising:

displaying an image by controlling a light emitting element formed in a pixel area defined by a plurality of scan lines and a plurality of data lines; and performing a discharge operation of the plurality of scan lines by time-division control with respect to a discharge line connected to the plurality of scan lines, wherein a number of discharge lines is less than that of the plurality of scan lines, and wherein a control signal for controlling the discharge line has a predetermined duty-on time based on a short-circuit state of the light emitting element connected to the plurality of scan lines.

10. The method as claimed in claim 9, wherein the performing the discharge operation comprises performing the discharge operation by time-division control with respect to one discharge line commonly connected to the plurality of scan lines.

11. The method as claimed in claim 10, wherein the performing the discharge operation comprises receiving a control signal through one control line connected to a controller providing the control signal.

12. The method as claimed in claim 10, wherein the displaying the image comprises displaying the image on a display panel comprising a first display and a second display area, the discharge line comprises a first discharge line and a second discharge line, and the performing the discharge operation comprises performing the discharge operation through the first discharge line for the first display area and performing the discharge operation through the second discharge line for the second display area.

13. The method as claimed in claim 9, further comprising:

determining whether the light emitting element is the short-circuit; and adjusting, in response to determining that the short-circuit occurs, the duty-on time of the control signal.

14. The method as claimed in claim 13, wherein the determining whether the light emitting element is the short-circuit comprises:

detecting a voltage of each of the plurality of data lines;

comparing the detected voltage of each of the plurality of data lines with a predetermined threshold voltage; and determining, in response to the voltage value of the detected voltage being higher than the predetermined threshold voltage, that a short-circuit occurs.

* * * * *